United States Patent [19]

Anttila

[11] 4,341,271

[45] Jul. 27, 1982

[54] ROCK DRILLING METHOD

[75] Inventor: Antero Anttila, Tampere, Finland

[73] Assignee: OY. Tampella AB, Tampere, Finland

[21] Appl. No.: 142,801

[22] Filed: Apr. 22, 1980

Related U.S. Application Data

[63] Continuation of Ser. No. 820,997, Aug. 1, 1977.

[30] Foreign Application Priority Data

Aug. 25, 1976 [FI] Finland ..... 762440

[51] Int. Cl.[3] ..... E21B 6/00

[52] U.S. Cl. ..... 175/24; 173/1; 173/2; 173/105

[58] Field of Search ..... 173/1, 2, 11, 18, 19, 173/105–108, 111, 134, 163, 12; 175/25, 24, 27, 57

[56] References Cited

U.S. PATENT DOCUMENTS

| | | | |
|---|---|---|---|
| 2,552,840 | 5/1951 | Burke et al. | 173/2 |
| 3,307,638 | 3/1977 | Kurt | 173/105 |
| 4,147,219 | 4/1979 | Wallace | 173/12 |

FOREIGN PATENT DOCUMENTS

| | | | |
|---|---|---|---|
| 42580 | 9/1916 | Sweden | 173/105 |

*Primary Examiner*—William F. Pate, III

*Attorney, Agent, or Firm*—Ladas & Parry

[57] ABSTRACT

A rock drilling method according to which the drill is subjected to successive axial strikes and is rotated around its longitudinal axis. The direction of rotation is repeatedly reversed after the drill has rotated at least one revolution in one direction.

9 Claims, 1 Drawing Figure

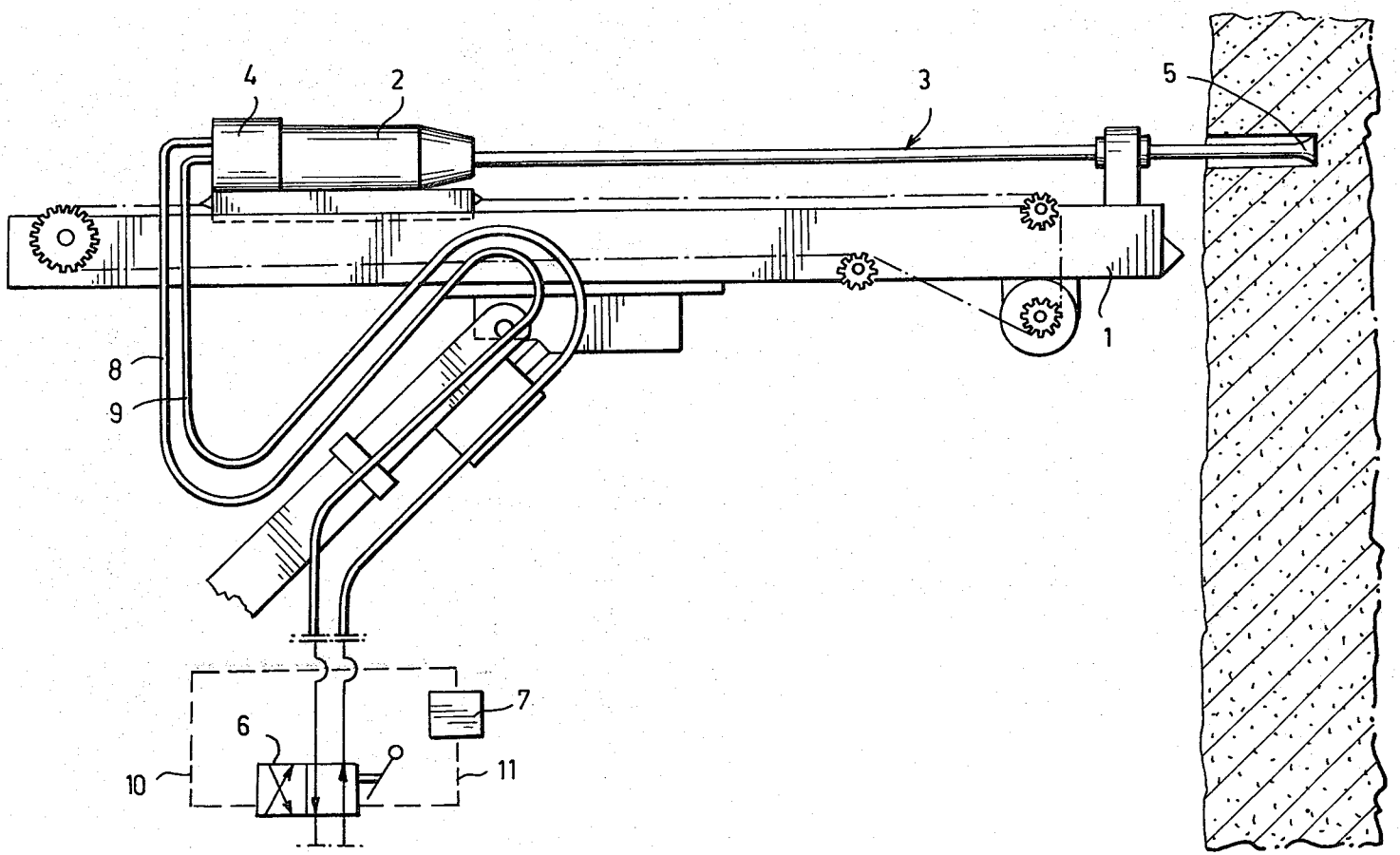
5
1
3
2
4
7
11
6
10
8
9

ROCK DRILLING METHOD

This is a continuation of co-pending Application Ser. No. 820,997 filed Aug. 1, 1977.

The present invention relates to a rock drilling method according to which the drilling is carried out by means of a drill striking against a rock and rotating around its longitudinal axis, whereby the direction of rotation of the drill is repeatedly reversed.

In a conventional drilling method the drill is continuously rotated in the same direction during the entire drilling operation. Due to this, the flanks of the hard metal bit of the drill tip are worn asymmetrically, whereby the flank which in relation to the direction of rotation is leading is subjected to harder wear so that the cutting edge of the hard metal bit is laterally displaced. When during sharpening an attempt is made to locate the cutting edge again in the centre of the hard metal bit, an unnecessarily big quantity of hard metal has to be removed and the service life of the hard metal bit is shortened. A drill which is worn asymetrically further leads to a deviation of the drilled hole from the desired direction of the hole.

From Swedish Pat. No. 42,580 it is previously known to repeatedly reverse the direction of rotation of the drill during drilling. The reversal of the direction of rotation of the drill is according to this patent accomplished by continuously reciprocating the drill around its axis by means of a crank mechanism turning the drill over an angle of abt. 90° between the reversing points. A continuous reversal of the direction of rotation of the drill results indeed in a more uniform wear of the drill bit, but a continuous reciprocating motion of the drill over a small angle in the way suggested in the Swedish patent, however, involves a number of essential disadvantages.

Because the drill performs a continuous reciprocating motion over a small angle, the rate of rotation of the drill changes according to a sine curve. Therefore the rate of rotation of the drill at the reversing points is momentarily zero and the rate of rotation of the drill bit continuously changes between two successive impacts. As the drill thus strikes at the reversing points of the direction of rotation practically at a standstill, the drill easily gets stuck in the stone. Due to the continuous change in the rate of rotation of the drill, the drill strikes the rock at irregular intervals which is a disadvantage as far as the loosening of the stone is concerned.

A continuous reciprocation of the drill rather rapidly over a small angle as suggested in the Swedish patent moreover requires a considerable amount of energy so as to change the direction of movement of the masses being in rotary motion. Such masses include the rotating elements of the rotary mechanism, the drill as well as the flushing liquid moving along with the drill bit and the drill. A frequent reversal of the direction of rotation of the drill, in addition, causes wear of the elements of rotary mechanism. A further disadvantage in the drilling method suggested in the Swedish patent is the fact that when the drill rotates in one direction over only abt. 90°, only a drill crown with four or more cutting edges can be used.

It is an object of the present invention to provide a new drilling method which makes it possible to utilize the advantages offered by drilling by means of continuously reversed direction of rotation without the disadvantages associated with the embodiment suggested by the Swedish patent, and this object is achieved by means of the drilling method according to the present invention which is characterized in that the direction of rotation of the drill is reversed after the drill has rotated at least one revolution in on direction.

The drilling method according to the invention is based on the idea that the direction of rotation of the drill is indeed repeatedly reversed, but at such intervals that the angle of rotation of the drill between two successive impacts remains practically constant during drilling. This is accomplished by means of reversing the direction of rotation of the drill preferably only after the drill has rotated several, even numerous revolutions corresponding to an essential length of drilling. The rate of rotation of the drill bit is indeed temporarily reduced at the reversing points of the direction of rotation of the drill and correspondingly increased back to the constant rate of rotation, but the number of such reversing points is only a fraction of the total number of revolutions that the drill performs during drilling.

By means of the drilling method according to the invention essential advantages are obtained as compared to the known reversible drilling method. As the rate of rotation of the drill remains constant during a longer rotary motion of the drill, is is possible to use an optimal relation between the number of impacts and the rate of rotation of the drill, whereby the angle of rotation of the drill bit between two successive strokes is the best possible as far as the loosening of the stone is concerned. In this way the highest possible drilling speed is achieved. Due to this, the drill does not get so easily stuck in the stone at the reversing points of the direction of rotation because the drill passes said reversing points at a higher speed. The direction of rotation is moreover reversed less frequently which results in a saving of energy, because the reversal of the masses in rotary motion correspondingly takes place less frequently. This also results in a lesser wear of the rotary mechanism. In the drilling method according to the invention, also conventional chisel bits can be used in addition to drill crowns provided with several cutting edges, thanks to which the method can be applied in a more versatile way. By permitting the drill to rotate long enough in the same direction before the rotating direction is reversed a straighter hole can be drilled as compared to conventional drilling carried out by means of continuous rotation in one direction only, because the reversal of the direction of rotation straightens any deviation of the direction of the hole and the drilling itself can be effected between the reversals under circumstances which remain as constant as possible. The reversal of the direction of rotation of the drill is preferably carried out after the drill has rotated a number of revolutions corresponding to a predetermined length of drilling, and at least once, preferably several times, e.g. 3 to 10 items during the entire length of drilling depending on the drilling circumstances, the rock quality, drill quality, etc.

The invention will now be described in more detail with reference to the accompanying drawing showing a schematic side view of a drilling unit for the application of the drilling method according to the invention.

The drilling unit shown in FIG. 1 includes a feeding device 1 for a rock drilling machine 2, a drill indicated generally with the reference numeral 3, and a rotating motor 4. The drill 3 is provided with a bit portion 5 penetrating into the rock. The drilling machine 2 comprises an impact mechanism (not shown) and the motor 4. The impact mechanism repeatedly subjects the rear end of the drill 3 to impact and the motor 4 rotates the drill. A valve 6 controlling the motor 4 is controlled either manually or by means of a control centre 7. Channels leading from the valve 6 to the motor 4 are generally indicated with the reference numerals 8 and 9. The channels 8 and 9 are connected to a source of pressure medium (not shown) and to an outlet (not shown) via the valve 6. By means of the valve 6 the direction of rotation of the rotatory motor 4 of the drill 3 is repeatedly reversed in accordance with a predetermined programme. The control connections of the valve 6 are designated with numerals 10 and 11. The control connections 10 and 11 are connected to the control centre 7 which alternately sends a control signal to the connections 10 and 11, whereby the direction of rotation is repeatedly reversed. The control centre 7 may function as an independent unit as, for example, when the direction of rotation is always reversed after a predetermined time or after a predetermined number of revolutions of the drill, or it can receive a control impulse according to the position of the drilling machine 2, whereby the direction of rotation is always reversed after a predetermined length of drilling.

The drawing and the accompanying specification are only intended to illustrate the idea of the invention. In its details the drilling method according to the invention may vary considerably within the scope of the claims.

What I claim is:

1. A rock drilling apparatus, comprising a rock drill adapted to receive an elongate drill steel and rotate the drill steel bidirectionally about the longitudinal axis thereof, a feeding device upon which the rock drill is mounted to be advanced and retracted in directions parallel to said longitudinal axis, and control means connected to said rock drill for automatically reversing the direction of rotation of the drill steel in accordance with a predetermined program and independently of the change of the direction of movement of the rock drill after the steel has completed several full turns in either direction.

2. Drilling apparatus as claimed in claim 1, wherein said control means is operative automatically to reverse the direction of rotation of the drill steel only after the rock drill has advanced a predetermined distance in said direction parallel to said longitudinal axis.

3. A drilling apparatus as claimed in claim 1, wherein said control means is operative automatically to reverse the direction of rotation of the drill steel only after a predetermined time has elapsed.

4. A drilling apparatus as claimed in claim 1, wherein said control means is operative automatically to reverse the direction of rotation of the drill steel only after the steel has completed a predetermined number of full turns in one direction.

5. A drilling apparatus as claimed in claim 1, wherein the control means is operative automatically to reverse the direction of rotation of the drill steel at least once during drilling of each hole.

6. A drilling apparatus as claimed in claim 1, further comprising power means for advancing the rock drill along the feeding device.

7. A drilling apparatus as claimed in claim 1, wherein said rock drill includes a motor operable by fluid under pressure to rotate the drill steel, and the control means includes a valve for reversing the connections to the motor in order to reverse the direction of rotation of the drill steel.

8. A rock drilling apparatus, comprising a rock drill adapted to receive an elongate drill steel and rotate the drill steel bidirectionally about the longitudinal axis thereof, a feeding device upon which the rock drill is mounted to be advanced and retracted in directions parallel to said longitudinal axis, means for advancing the rock drill along the feeding device, and control means connected to said rock drill for automatically, and independently of the change of the direction of movement of the rock drill, reversing the direction of rotation of the drill steel after the steel has completed several full turns in either direction, the rock drill including means for delivering impacts to said drill steel and further including a motor operable by fluid under pressure to rotate the drill steel, and the control means including valve means for reversing the connections of said motor in order to reverse the direction of rotation of the drill steel.

9. Drilling apparatus as claimed in claim 8, comprising sensing means for automatically actuating the control means in response to a parameter selected from the group consisting of the position of the drill with respect to the feeding device, the time which has elapsed following the previous reversal of direction of rotation, and the number of revolutions completed following the previous reversal of direction of rotation.

* * * * *